US010236107B2

(12) United States Patent
Choi

(10) Patent No.: US 10,236,107 B2
(45) Date of Patent: Mar. 19, 2019

(54) MAGNETIC FLUX CONTROL DEVICE

(71) Applicant: Tae Kwang Choi, Gwangmyeong-si (KR)

(72) Inventor: Tae Kwang Choi, Gwangmyeong-si (KR)

( * ) Notice: Subject to any disclaimer, the term of this patent is extended or adjusted under 35 U.S.C. 154(b) by 338 days.

(21) Appl. No.: 15/039,841

(22) PCT Filed: Mar. 3, 2016

(86) PCT No.: PCT/KR2016/002152
§ 371 (c)(1),
(2) Date: May 26, 2016

(87) PCT Pub. No.: WO2016/178473
PCT Pub. Date: Nov. 10, 2016

(65) Prior Publication Data

US 2017/0103839 A1 Apr. 13, 2017

(30) Foreign Application Priority Data

May 4, 2015 (KR) ..... 10-2015-0062559
Feb. 1, 2016 (KR) ..... 10-2016-0012438

(51) Int. Cl.
*H01F 7/20* (2006.01)
*H01F 7/02* (2006.01)
*H01F 7/06* (2006.01)
*H01F 7/16* (2006.01)

(52) U.S. Cl.
CPC ..... *H01F 7/0273* (2013.01); *H01F 7/064* (2013.01); *H01F 7/066* (2013.01); *H01F 7/1646* (2013.01)

(58) Field of Classification Search
CPC . H01F 7/0257; H01F 7/04; H01F 7/06; H01F 7/86
USPC ..... 335/289
See application file for complete search history.

(56) References Cited

U.S. PATENT DOCUMENTS 4,075,589 A * 2/1978 Braillon ..... B23Q 3/1546 335/286
4,090,162 A * 5/1978 Cardone ..... B23Q 3/1546 335/289
4,542,361 A * 9/1985 Cavanagh ..... H01F 7/0257 335/230
4,847,582 A * 7/1989 Cardone ..... B23Q 3/1546 335/289
5,243,314 A * 9/1993 Maruyama ..... B23Q 3/1546 269/8

(Continued)

*Primary Examiner* — Shawki S Ismail
*Assistant Examiner* — Lisa N Homza
(74) *Attorney, Agent, or Firm* — Hauptman Ham, LLP

(57) ABSTRACT

A magnetic flux control device according to the exemplary embodiment includes: a pole piece assembly which is provided with an N pole piece and an S pole piece which are formed with first surfaces and second surfaces and made of a ferromagnetic material, and a permanent magnet which is disposed such that an N-pole is in contact with the N pole piece and an S-pole is in contact with the S pole piece; a first outer pole piece, a second outer pole piece, and a base pole piece which are formed with first surfaces and second surfaces and made of a ferromagnetic material; a coil which is wound around at least one of the N pole piece, the S pole piece, the first outer pole piece, the second outer pole piece, and the base pole piece; and a control unit which controls electric current to be applied to the coil.

35 Claims, 17 Drawing Sheets

(56) References Cited

U.S. PATENT DOCUMENTS 5,334,965 A * 8/1994 Dolgin ..... B64G 1/22 335/216
6,288,623 B1 * 9/2001 Janzen ..... B66C 1/04 335/289
6,489,871 B1 * 12/2002 Barton ..... B25B 11/002 335/285
7,015,780 B2 * 3/2006 Bernstein ..... G02B 26/0841 335/285
7,619,499 B2 * 11/2009 Wieler ..... H01H 5/02 269/8
7,843,295 B2 * 11/2010 Fullerton ..... G09F 7/04 24/303
7,843,296 B2 * 11/2010 Fullerton ..... G09F 7/04 24/303
8,832,940 B2 * 9/2014 Sarh ..... B21J 15/14 269/8
8,970,334 B2 * 3/2015 Choi ..... H01F 7/04 335/285
2007/0290780 A1 * 12/2007 Tiberghien ..... B25B 11/002 335/285
2010/0013583 A1 * 1/2010 Kimura ..... B29C 45/1742 335/294
2011/0037547 A1 * 2/2011 Cardone ..... B23Q 3/1543 335/290
2012/0256715 A1 * 10/2012 Fullerton ..... H01F 7/021 335/285
2013/0135067 A1 * 5/2013 Choi ..... B23Q 3/1543 335/290
2016/0005519 A1 * 1/2016 Choi ..... H01F 7/0257 335/290

* cited by examiner

MAGNETIC FLUX CONTROL DEVICE

CROSS REFERENCE TO RELATED APPLICATION

This application claims the benefit of priorities from Korean Patent Application No. 10-2015-0062559 filed May 4, 2015 and Korean Patent Application No. 10-2016-0012438 filed Feb. 1, 2016 in the KIPO (Korean Intellectual Property Office). Further, this application is the National Phase application of International Application No. PCT/KR2016/002152 filed Mar. 3, 2016, which designates the United States and was published in Korean.

TECHNICAL FIELD

The present disclosure relates to a magnetic flux control device, and more particularly, to a magnetic flux control device which controls intensity of magnetic flux leaking to the outside by controlling magnetic flux from a permanent magnet.

BACKGROUND ART

In general, a permanent magnet forms a magnetic field at the periphery of the permanent magnet, and magnetically affects a magnetic material positioned in the magnetic field. However, since the magnetic flux caused by the permanent magnet is difficult to be controlled, alternative means such as an electromagnet have been used.

However, the electromagnet has problems in terms of stability because electric current needs to be consistently supplied to the electromagnet so as to generate magnetic force, and in a case in which the supply of electric current is suddenly shut off, magnetic force is eliminated, and as a result, a held magnetic material may be released. An expensive uninterruptible power supply (UPS) needs to be additionally added to an electromagnetic device in order to ensure stability. Therefore, the electromagnetic device consistently consumes electric current and needs to be equipped with the uninterruptible power supply to ensure stability, and as a result, there are problems in terms of production costs and maintenance costs.

Accordingly, the present applicant has developed devices which generate a magnetic field outside the device or eliminate the magnetic field by controlling magnetic flux from the permanent magnet, and have an effect on a magnetic material (see Patent Literature 1 to 3).

(Patent Literature 1)

Korean Patent No. 10-1319052B (Magnetic Substance Holding Device Using Permanent Magnet Energy Control)

(Patent Literature 2)

Korean Patent No. 10-1498864B (Magnetic Substance Holding Device)

(Patent Literature 3)

Korean Patent No. 10-1512610B (Magnetic Substance Holding Device)

DISCLOSURE

Technical Problem

The present disclosure has been made in an effort to provide a magnetic flux control device capable of generating a magnetic field outside the device or eliminating the magnetic field by controlling magnetic flux from a permanent magnet.

Technical problems of the present disclosure are not limited to the aforementioned technical objects, and other technical objects, which are not mentioned above, may be clearly understood by those skilled in the art from the following descriptions.

Technical Solution

A magnetic flux control device according to an exemplary embodiment of the present disclosure includes: a pole piece assembly which is provided with an N pole piece which is formed with a first surface and a second surface and made of a ferromagnetic material, an S pole piece which is formed with a first surface and a second surface and made of a ferromagnetic material, and a permanent magnet which is disposed such that an N-pole is in contact with the N pole piece and an S-pole is in contact with the S pole piece; a first outer pole piece which is formed with a first surface and a second surface and made of a magnetic material; a second outer pole piece which is formed with a first surface and a second surface and made of a magnetic material; a base pole piece which is formed with a first surface and a second surface and made of a magnetic material; a coil which is wound around at least one of the N pole piece, the S pole piece, the first outer pole piece, the second outer pole piece, and the base pole piece; and a control unit which controls electric current to be applied to the coil. The first surface of the N pole piece faces the first surface of the base pole piece, the first surface of the S pole piece faces the second surface of the base pole piece, the second surface of the N pole piece faces the first surface of the first outer pole piece, and the second surface of the S pole piece faces the first surface of the second outer pole piece. The pole piece assembly is movable between a first position where the first surface and the second surface of the base pole piece are magnetically spaced apart from the first surface of the N pole piece and the first surface of the S pole piece, respectively, and the second surface of the N pole piece and the second surface of the S pole piece are magnetically in contact with the first surface of the first outer pole piece and the first surface of the second outer pole piece, respectively, and a second position where the first surface and the second surface of the base pole piece are magnetically in contact with the first surface of the N pole piece and the first surface of the S pole piece, respectively, and the second surface of the N pole piece and the second surface of the S pole piece are magnetically spaced apart from the first surface of the first outer pole piece and the first surface of the second outer pole piece, respectively. The control unit controls electric current to be applied to the coil so as to move the pole piece assembly between the first position and the second position, and thus to change magnetic flux at the second surface of the first outer pole piece and the second surface of the second outer pole piece.

According to another aspect of the present disclosure, the S pole piece is a first S pole piece, the permanent magnet is a first permanent magnet, and the magnetic flux control device further includes a third outer pole piece which is formed with a first surface and a second surface and made of a ferromagnetic material. The pole piece assembly further includes a second S pole piece which is formed with a first surface and a second surface and made of a ferromagnetic material, and a second permanent magnet which is disposed such that an N-pole is in contact with the N pole piece and an S-pole is in contact with the second S pole piece. The base pole piece further includes a third surface, the first surface of the second S pole piece faces the third surface of the base pole piece, and the second surface of the second S pole piece faces the first surface of the third outer pole piece. The first surface of the second S pole piece and the third surface of the base pole piece are magnetically spaced apart from each other and the second surface of the second S pole piece and the first surface of the third outer pole piece are magnetically in contact with each other when the pole piece assembly is positioned at the first position, and the first surface of the second S pole piece and the third surface of the base pole piece are magnetically in contact with each other and the second surface of the second S pole piece and the first surface of the third outer pole piece are magnetically spaced apart from each other when the pole piece assembly is positioned at the second position. The coil is wound around at least one of the N pole piece, the first S pole piece, the second S pole piece, the first outer pole piece, the second outer pole piece, the third outer pole piece, and the base pole piece.

According to still another aspect of the present disclosure, the N pole piece is a first N pole piece, the permanent magnet is a first permanent magnet, and the magnetic flux control device further includes a third outer pole piece which is formed with a first surface and a second surface and made of a ferromagnetic material. The pole piece assembly further includes a second N pole piece which is formed with a first surface and a second surface and made of a ferromagnetic material, and a second permanent magnet which is disposed such that an S-pole is in contact with the S pole piece and an N-pole is in contact with the second N pole piece. The base pole piece further includes a third surface, the first surface of the second N pole piece faces the third surface of the base pole piece, and the second surface of the second N pole piece faces the first surface of the third outer pole piece. The first surface of the second N pole piece and the third surface of the base pole piece are magnetically spaced apart from each other and the second surface of the second N pole piece and the first surface of the third outer pole piece are magnetically in contact with each other when the pole piece assembly is positioned at the first position, and the first surface of the second N pole piece and the third surface of the base pole piece are magnetically in contact with each other and the second surface of the second N pole piece and the first surface of the third outer pole piece are magnetically spaced apart from each other when the pole piece assembly is positioned at the second position. The coil is wound around at least one of the first N pole piece, the second N pole piece, the S pole piece, the first outer pole piece, the second outer pole piece, the third outer pole piece, and the base pole piece.

According to yet another aspect of the present disclosure, the coils include at least one first coil which is positioned on the path of internally circulating magnetic flux formed when the pole piece assembly is positioned at the second position, and at least one second coil which is positioned between the permanent magnet and the second surface of the first outer pole piece or between the permanent magnet and the second surface of the second outer pole piece.

According to still yet another aspect of the present disclosure, the coils include at least one first coil which is positioned on the path of internally circulating magnetic flux formed when the pole piece assembly is positioned at the second position, and at least one second coil which is positioned between the first permanent magnet and the second surface of the second outer pole piece, between the first permanent magnet and the second permanent magnet and the second surface of the first outer pole piece, or between the second permanent magnet and the second surface of the third outer pole piece.

According to a further aspect of the present disclosure, the coil is wound around the N pole piece, and the coils include a first coil which is positioned between the first permanent magnet and the second permanent magnet and the base pole piece, and a second coil which is positioned between the first permanent magnet and the second permanent magnet and the first outer pole piece.

According to another further aspect of the present disclosure, the coil is wound around the S pole piece, and the coils include a first coil which is positioned between the first permanent magnet and the second permanent magnet and the base pole piece, and a second coil which is positioned between the first permanent magnet and the second permanent magnet and the second outer pole piece.

According to still another further aspect of the present disclosure, an area of the first surface of the first outer pole piece is larger than an area of the second surface of the first outer pole piece.

According to yet another further aspect of the present disclosure, an area of the first surface of the second outer pole piece is larger than an area of the second surface of the second outer pole piece.

According to still yet another further aspect of the present disclosure, an area or the first surface of the third outer pole piece is larger than an area of the second surface of the third outer pole piece.

According to a still further aspect of the present disclosure, the pole piece assembly further includes a fixing means which inhibits relative movements between the pole pieces included in the pole piece assembly.

According to a yet further aspect of the present disclosure, the coil is not wound around the pole pieces included in the pole piece assembly.

According to a still yet further aspect of the present disclosure, any one of the N pole piece and the S pole piece is disposed to surround the other of the N pole piece and the S pole piece.

According to a further aspect of the present disclosure, the S pole piece is disposed to surround the N pole piece, the second outer pole piece is disposed to surround the first outer pole piece, and an outer support body, which is disposed to surround the pole piece assembly, is further provided between the base pole piece and the second outer pole piece.

According to another further aspect of the present disclosure, the N pole piece is disposed to surround the S pole piece, the first outer pole piece is disposed to surround the second outer pole piece, and an outer support body, which is disposed to surround the pole piece assembly, is further provided between the base pole piece and the first outer pole piece.

According to still another further aspect of the present disclosure, the magnetic flux control device further includes an inner support body which is disposed between the base pole piece and the first outer pole piece, penetrates the N pole piece, and guides the movement of the pole piece assembly.

According to yet another further aspect of the present disclosure, the magnetic flux control device further includes an inner support body which is disposed between the base pole piece and the second outer pole piece, penetrates the S pole piece, and guides the movement of the pole piece assembly.

According to still yet another further aspect of the present disclosure, the magnetic flux control further includes a coupling bolt which penetrates the inner support body such that an end portion of the coupling bolt is thread-coupled to the base pole piece and a head of the coupling bolt is caught by the first outer pole piece so as to couple the base pole piece and the first outer pole piece.

According to a still further aspect of the present disclosure, the magnetic flux control device further includes a coupling bolt which penetrates the inner support body such that an end portion of the coupling bolt is thread-coupled to the base pole piece and a head of the coupling bolt is caught by the second outer pole piece so as to couple the base pole piece and the second outer pole piece.

According to a yet further aspect of the present disclosure, the magnetic flux control device further includes a coupling bolt which penetrates the inner support body such that an end portion of the coupling bolt is thread-coupled to the first outer pole piece and a head of the coupling bolt is caught by the base pole piece so as to couple the base pole piece and the first outer pole piece.

According to a still yet further aspect of the present disclosure, the magnetic flux control device further include a coupling bolt which penetrates the inner support body such that an end portion of the coupling bolt is thread-coupled to the second outer pole piece and a head of the coupling bolt is caught by the base pole piece so as to couple the base pole piece and the second outer pole piece.

According to a further aspect of the present disclosure, the outer support body is made of a paramagnetic material or a non-magnetic material.

According to another further aspect of the present disclosure, the inner support body is made of a paramagnetic material or a non-magnetic material.

According to still another further aspect of the present disclosure, the base pole piece is provided with a protruding portion that includes the first surface of the base pole piece, and the coil is disposed to be wound around the protruding portion.

According to yet another further aspect of the present disclosure, the base pole piece is provided with a protruding portion that includes the second surface of the base pole piece, and the coil is disposed to be wound around the protruding portion.

According to still yet another further aspect of the present disclosure, the coil is disposed to be wound around the first outer pole piece.

According to a still further aspect of the present disclosure, the coil is disposed to be wound around the second outer pole piece.

According to a yet further aspect of the present disclosure, an area of the first surface of the first outer pole piece is larger than an area of the second surface of the first outer pole piece.

According to a still yet further aspect of the present disclosure, an area of the first surface of the second outer pole piece is larger than an area of the second surface of the second outer pole piece.

According to a further aspect of the present disclosure, any one of the second surface of the first outer pole piece and the second surface of the second outer pole piece has a circular shape.

According to another further aspect of the present disclosure, any one of the second surface of the first outer pole piece and the second surface of the second outer pole piece has a quadrangular shape.

Advantageous Effects

The magnetic flux control device according to the present disclosure may control the occurrence of a magnetic field outside the device and the elimination of a magnetic field by using a small amount of electricity, and thus may have an effect on a magnetic material positioned outside the device. That is, according to the magnetic flux control device according to the present disclosure, the magnetic material may be held or released with low energy consumption and the movement of an external magnetic material may be caused with low energy consumption.

DETAILED DESCRIPTION OF THE PREFERRED EMBODIMENT

Figure 1A:
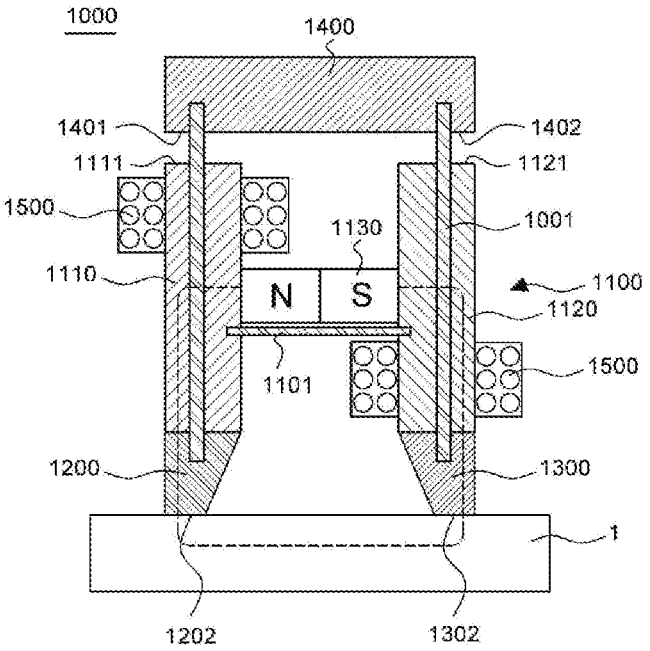
FIGS. 1A to 1D are schematic cross-sectional views of a magnetic flux control device according to an exemplary embodiment of the present disclosure. In addition.

Advantages and features of the present disclosure and methods of achieving the advantages and features will be clear with reference to exemplary embodiments described in detail below together with the accompanying drawings. However, the present disclosure is not limited to the exemplary embodiments set forth below, and may be embodied in various other forms. The present exemplary embodiments are for rendering the disclosure of the present disclosure complete and are set forth to provide a complete understanding of the scope of the disclosure to a person with ordinary skill in the technical field to which the present disclosure pertains, and the present disclosure will only be defined by the scope of the claims.

When an element or layer is referred to as being "on" another element or layer, it can be directly on the other element or layer or intervening elements or layers may also be present.

Terms "first", "second", and the like may be used to describe various constituent elements, but the constituent elements are not limited by these terms. These terms are used only to distinguish one constituent element from another constituent element. Therefore, the first constituent element mentioned hereinafter may of course be the second constituent element within the technical spirit of the present disclosure.

Like reference numerals indicate like elements throughout the specification.

The size and thickness of each component illustrated in the drawings are shown for ease of description, but the present disclosure is not necessarily limited to the size and thickness of the illustrated component.

Respective features of several exemplary embodiments of the present disclosure may be partially or entirely coupled to or combined with each other, and as sufficiently appreciated by those skilled in the art, various technical cooperation and operations may be carried out, and the respective exemplary embodiments may be implemented independently of each other or implemented together correlatively.

First, basic configurations and principles of a magnetic flux control device according to the present disclosure will be described with reference to FIGS. 1A to 1E.

Figure 1B:
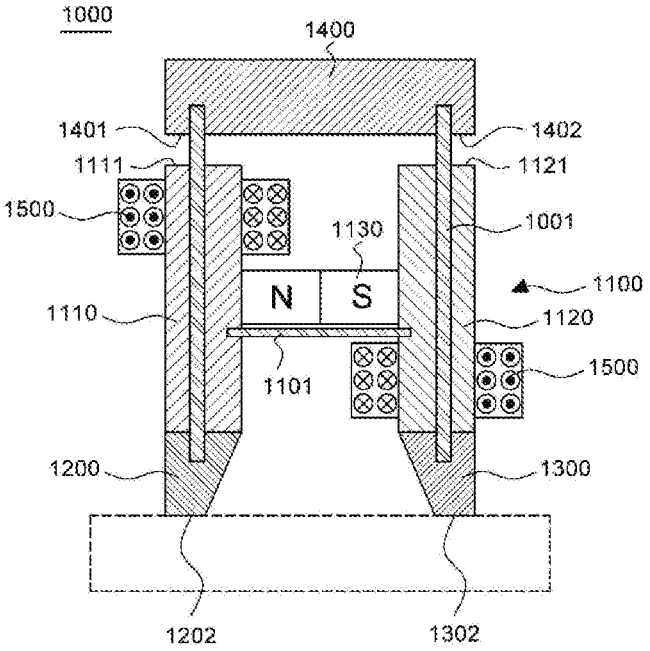

FIGS. 1A to 1D are schematic cross-sectional views of a magnetic flux control device according to an exemplary embodiment of the present disclosure. In addition, FIG. 1E illustrates a modified embodiment in which only coils are disposed differently from those of the magnetic flux control device in FIGS. 1A to 1D.

Referring to FIGS. 1A to 1D, a magnetic flux control device 1000 according to the present exemplary embodiment includes a pole piece assembly 1100, a first outer pole piece 1200, a second outer pole piece 1300, a base pole piece 1400, coils 1500, and a control unit (not illustrated).

The pole piece assembly 1100 includes an N pole piece 1110, an S pole piece 1120, and a permanent magnet 1130. The N pole piece 1110 is a ferromagnetic material such as iron, and provided with a first surface 1111 and a second surface 1112. In addition, the S pole piece 1120 is a ferromagnetic material such as iron, and provided with a first surface 1121 and a second surface 1122. The permanent magnet 1130 is disposed such that an N-pole is in contact with the N pole piece 1110, and an S-pole is in contact with the S pole piece 1120.

The pole piece assembly 1100 is configured to be moved between the base pole piece 1400 and outer pole pieces 1200 and 1300 to be described below, and thus at least one fixing means 1101 may be provided so that the N pole piece 1110 and the S pole piece 1120 are fixed to each other. The fixing means 1101 may be made of a non-magnetic material which has no effect on magnetic flux or a paramagnetic material such as aluminum which has a small effect on magnetic flux, and the fixing means 1101 may be a headless bolt having no head in order to minimize an internal space occupied by the N pole piece 1110 and the S pole piece 1120.

The first outer pole piece 1200 is provided with a first surface 1201 and a second surface 1202, and made of a ferromagnetic material such as iron. In addition, the second outer pole piece 1300 is provided with a first surface 1301 and a second surface 1302, and made of a ferromagnetic material such as iron. In addition, the base pole piece 1400 is provided with a first surface 1401 and a second surface 1402, and made of a ferromagnetic material such as iron.

The first surface 1111 of the N pole piece 1110 faces the first surface 1401 of the base pole piece 1400. The first surface 1121 of the S pole piece 1120 faces the second surface 1402 of the base pole piece 1400. The second surface 1112 of the N pole piece 1110 faces the first surface 1201 of the first outer pole piece 1200. The second surface 1122 of the S pole piece 1120 faces the first surface 1301 of the second outer pole piece 1300. The pole pieces 1110, 1120, 1200, 1300, and 1400 are disposed such that these surfaces face one another, thereby providing a circuit for magnetic flux.

Figure 1C:
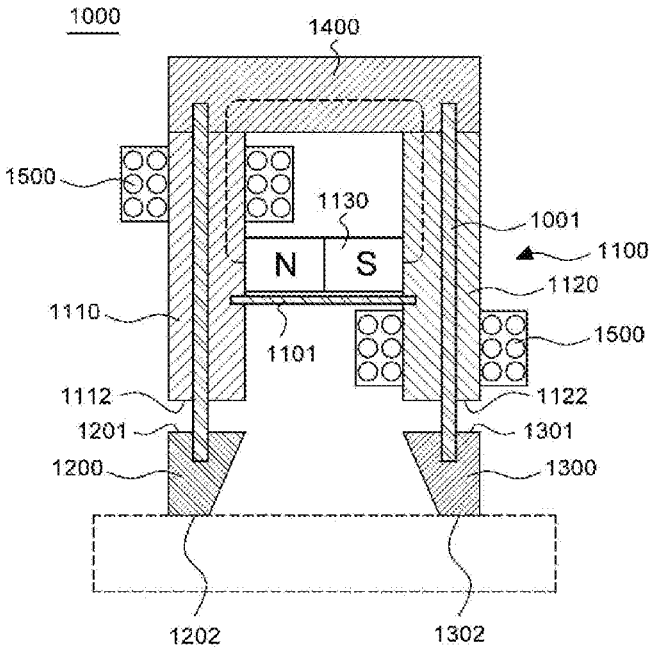
Figure 1D:
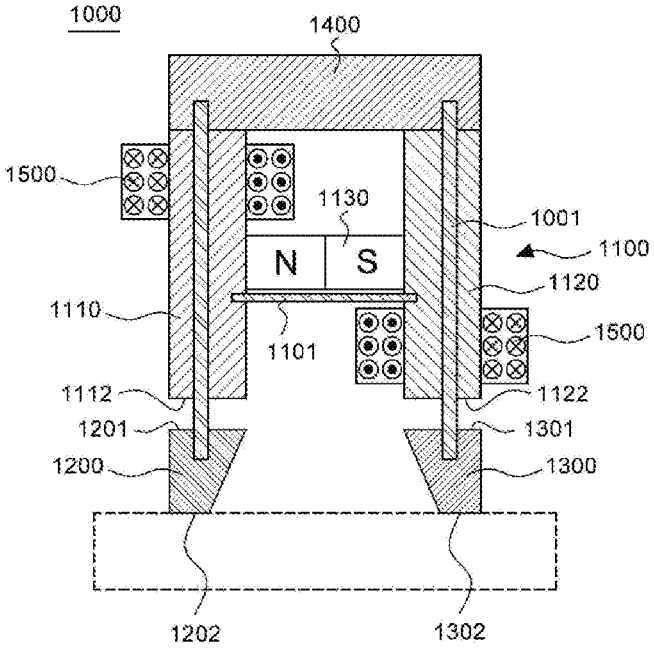
Figure 1E:
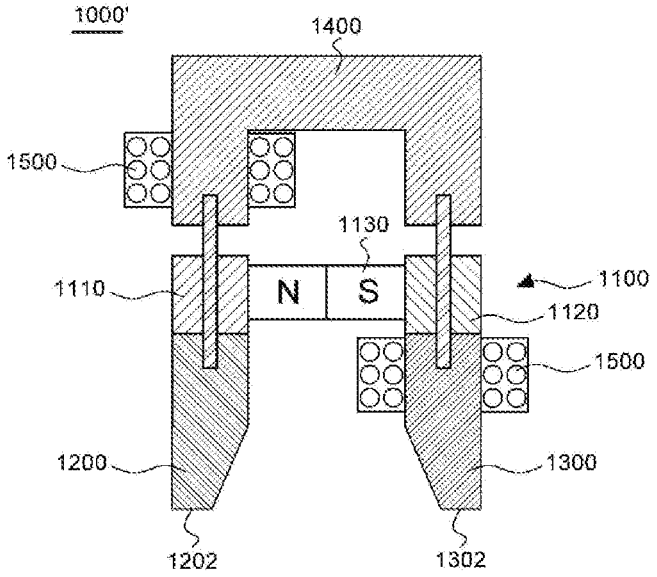
FIG. 1E illustrates a modified embodiment in which only coils are disposed differently from those of the magnetic flux control device in FIGS. 1A to 1D.

The pole piece assembly 1100 is configured to be movable between a first position (a position illustrated in FIGS. 1A and 1B) and a second position (a position illustrated in FIGS. 1C and 1D). Here, the first position means a position of the pole piece assembly 1100 when the first surface 1401 and the second surface 1402 of the base pole piece 1400 are magnetically spaced apart from the first surface 1111 of the N pole piece 1110 and the first surface 1121 of the S pole piece 1120, respectively, and the second surface 1112 of the N pole piece 1110 and the second surface 1122 of the S pole piece 1120 are magnetically in contact with the first surface 1201 of the first outer pole piece 1200 and the first surface 1301 of the second outer pole piece 1300, respectively. In addition, the second position means a position of the pole piece assembly 1100 when the first surface 1401 and the second surface 1402 of the base pole piece 1400 are magnetically in contact with the first surface 1111 of the N pole piece 1110 and the first surface 1121 of the S pole piece 1120, respectively, and the second surface 1112 of the N pole piece 1110 and the second surface 1122 of the S pole piece 1120 are magnetically spaced apart from the first surface 1201 of the first outer pole piece 1200 and the first surface 1301 of the second outer pole piece 1300, respectively.

Here, the 'magnetic contact' includes a case in which the surfaces come into direct contact with each other as illustrated in FIGS. 1A to 1D whereby the surfaces are magnetically connected to each other, and also includes a case in which the surfaces come into contact with each other with shock absorbing materials made of a rubber material interposed between the surfaces even though the surfaces are not in direct contact with each other. That is, even though the pole pieces are spaced apart from each other, it can be said that the surfaces are magnetically in contact with each other if attractive force between the pole pieces is, for example, 80% or higher (including 90% or higher, 70% or higher, etc.) of attractive force applied when the surfaces are in contact with each other.

In addition, the 'magnetically spaced' means that the surfaces are spaced apart from each other to the extent that attractive force is not greatly applied. For example, it can be said that the surfaces are magnetically spaced apart from each other if attractive force is, for example, 10% or lower (including 20% or lower, 5% or lower, etc.) of attractive force applied when the pole pieces are in contact with each other.

The movement of the pole piece assembly 1100 may be implemented in various ways. For example, in the present exemplary embodiment, guide bars 1001, which penetrate the pole piece assembly 1100, may be employed. The guide bar 4001 may be made of a non-magnetic material or a paramagnetic material so as not to affect magnetic flux. In addition, the movement of the pole piece assembly 1100 may be carried out by publicly known methods using a rail, a linear guide, or the like. In addition, another specific exemplary embodiment will be described below with reference to FIGS. 5A and 5B.

The coil 1500 may be wound around at least one of the N pole piece 1110, the S pole piece 1120, the first outer pole piece 1200, the second outer pole piece 1300, and the base pole piece 1400. When the coil 1500 is supplied with electric current, a magnetic field is formed and affects magnetic flux in the pole piece 1110, 1120, 1200, 1300, or 1400 around which the coil is wound.

The coil 1500 may control magnetic flux, and is positioned at an easy point. For example, in the present exemplary embodiment, the coils 1500 may be disposed, one on each of the N pole piece 1110 and the S pole piece 1120, in a state in which the permanent magnet 1130 is disposed between the coils. The disposition of the coils 1500 will be described below.

The control unit (not illustrated) controls a direction and intensity of electric current to be applied to the coil 1500. The control unit supplies direct current to the coil 1500 so as to form a magnetic field at the periphery of the coil 1500.

A method of operating the magnetic flux control device 1000 having the aforementioned configurations will be described below.

Referring to FIG. 1A, when the pole piece assembly 1100 is disposed at the first position, the second surface 1202 of the first outer pole piece 1200 and the second surface 1302 of the second outer pole piece 1300 are magnetized by the permanent magnet 1130, such that a magnetic field is formed outside the second surfaces 1202 and 1302. That is, when a magnetic material or a permanent magnet is positioned outside the second surfaces 1202 and 1302, attractive force or repulsive force is applied. For example, in a case in which the pole piece assembly 1100 is positioned as illustrated in FIG. 1A, an attachment object 1, which is a magnetic material such as iron, may be held on the second surfaces 1202 and 1302. When the attachment object 1 is held, magnetic flux is formed as indicated by a dotted line (a state illustrated in FIG. 1A is referred to as a 'magnetic field applied state').

To minimize or eliminate the magnetic field formed by the second surface 1202 of the first outer pole piece 1200 and the second surface 1302 of the second outer pole piece 1300, the control unit may apply electric current to the coil 1500 as illustrated in FIG. 1B.

A direction of the electric current applied to the coil 1500 is set to reduce magnetic flux as indicated by the dotted line in FIG. 1A and to allow the magnetic flux from the permanent magnet 1130 to be induced toward the base pole piece 1400.

As intensity of electric current applied to the coil 1500 increases, the magnetic flux indicated by the dotted line in FIG. 1A is weakened, and magnetic flux, which is directed toward the outer pole pieces 1200 and 1300, may be almost eliminated when the electric current has predetermined intensity. In this case, the magnetic flux from the permanent magnet 1130 is directed toward the first surface 1111 of the N pole piece 1110 and the first surface 1121 of the S pole piece 1120, such that attractive force is applied between the base pole piece 1400 and the N pole piece 1110/the S pole piece 1120. Therefore, the pole piece assembly 1100 is moved to the second position, and comes into contact with the base pole piece 1400.

When the pole piece assembly 1100 and the base pole piece 1400 come into contact with each other, magnetic flux is formed as indicated by a dotted line in FIG. 1C. The magnetic flux circulates in the magnetic flux control device 1000, and thus defined as "internally circulating magnetic flux". Once the internally circulating magnetic flux is formed, an outflow of the magnetic flux, which is caused by the permanent magnet 1130, to the outside of the device 1000 is minimized. In particular, predetermined residual magnetism may be formed at the second surface 1112 of the N pole piece 1110 and the second surface 1122 of the S pole piece 1120, but since the N pole piece 1110 and the S pole piece 1120 are spaced apart from the first outer pole piece 1200 and the second outer pole piece 1300, respectively, residual magnetism may not be nearly formed at the second surfaces 1202 and 1302 of the first outer pole piece 1200 and the second outer pole piece 1300, or residual magnetism may be zero (a state illustrated in FIG. 1C is referred to as a 'no magnetic field applied state').

To make the state as illustrated in FIG. 1A, that is, the magnetic field applied state again, electric current is applied to the coil 1500 as illustrated in FIG. 1D. In this case, a direction in which the electric current is applied to the coil 1500 is opposite to the direction in which electric current is applied to the coil 1500 as illustrated in FIG. 1B. When electric current is applied as illustrated in FIG. 1D, the internally circulating magnetic flux is weakened, and the pole piece assembly 1100 is moved back to the first position. Therefore, a magnetic field is formed outside the second surfaces 1202 and 1302 of the first outer pole piece 1200 and the second outer pole piece 1300.

As described above, the control unit controls electric current to be applied to the coil 1500 so as to allow the pole piece assembly 1100 to be movable between the first position and the second position, and thus to maximize or minimize the formation of the magnetic field outside the second surfaces 1202 and 1302 of the first outer pole piece 1200 and the second outer pole piece 1300 (i.e., the magnetic field applied state and the no magnetic field applied state may be changed to each other).

In this case, it is necessary to apply electric current to the coil 1500 only when the magnetic field applied state and the no magnetic field applied state are changed, and electric current may be applied only to the extent to change the path of the magnetic flux. In the magnetic field applied state illustrated in FIG. 1A and the no magnetic field applied state illustrated in FIG. 1C, any consumption of electric current is not needed, and as a result, it is possible to minimize consumption of electricity. In addition, even in an emergency situation in which electric current being applied to the coil 1500 is shut off, the current state is maintained even though the magnetic field applied state and the no magnetic field applied state are changed, and thus the magnetic flux control device is excellent in terms of safety.

Meanwhile, the coil 1500 may be disposed in various ways, and like a magnetic flux control device 1000' in FIG. 1E, the coils 1500 may also be disposed on the first outer pole piece 1200, the second outer pole piece 1300, and the base pole piece 1400. For example, only a single coil 1500 may be disposed. In a case in which the coil 1500 is disposed without being wound around the pole piece assembly 1100 as illustrated in FIG. 1E, the pole piece assembly 1100 is light in weight and thus advantageous for movement.

Accordingly, the coils 1500 may include at least one first coil which is positioned on the path of the internally circulating magnetic flux formed when the pole piece assembly 1100 is positioned at the second position as illustrated in FIG. 1C, and at least one second coil which is positioned between the permanent magnet 1130 and the second surface 1202 of the first outer pole piece 1200 or between the permanent magnet 1130 and the second surface 1302 of the second outer pole piece 1300. For example, in the exemplary embodiment as illustrated in FIGS. 1A to 1D, the first coil is a coil wound around the N pole piece 1110, and in the exemplary embodiment as illustrated in FIG. 1E, the first coil is a coil wound around the base pole piece 1400. In addition, in the exemplary embodiment as illustrated in FIGS. 1A to 1D, the second coil is a coil wound around the S pole piece 1120, and in the exemplary embodiment as illustrated in FIG. 1E, the second coil is a coil wound around the second outer pole piece 1300.

The coil 1500 may be disposed in more various other ways than described above. The larger the number of coils 1500, the smaller the magnitude of electric current for changing the magnetic field applied state and the no magnetic field applied state and the smaller the number of turns of the coil 1500. However, the larger the number of coils 1500, the more complicated the wiring and the larger the occupied space. Therefore, the number and the disposition of coils 1500 need to be optimized to change the magnetic field applied state and the no magnetic field applied state, easily control magnetic flux, and minimize an occupied internal space. The number and the disposition of coils 1500 may be determined through experiments, taking into account of the number of permanent magnets 1130, intensity, thicknesses or lengths of the pole pieces 1110, 1120, 1200, 1300, and 1400, and the like.

FIGS. 2A to 2D are schematic cross-sectional views of a magnetic flux control device according to yet another exemplary embodiment of the present disclosure. In addition, FIGS. 2E and 2F illustrate a modified embodiment in which only coils are disposed differently from those of the magnetic flux control device in FIGS. 2A to 2D.

Referring to FIGS. 2A to 2D, a magnetic flux control device 2000 according to the present exemplary embodiment includes a pole piece assembly 2100, a first outer pole piece 2200, a second outer pole piece 2300, a base pole piece 2400, coils 2500, and a third outer pole piece 2600.

The magnetic flux control device 2000 according to the present exemplary embodiment is made by laterally expanding the magnetic flux control device 1000 in FIGS. 1A to 1D. To this end, the pole piece assembly 2100 further includes one permanent magnet 2150 and one S pole piece 2140 in comparison with the pole piece assembly 1100 of the magnetic flux control device 1000, the base pole piece 2400 is further elongated laterally, and the magnetic flux control device 2000 further includes the third outer pole piece 2600.

The pole piece assembly 2100 includes an N pole piece 2110, a first S pole piece 2120, a first permanent magnet 2130, a second S pole piece 2140, and a second permanent magnet 2150. Here, because the N pole piece 2110, the first S pole piece 2120, and the first permanent magnet 2130 are identical to the N pole piece 1110, the S pole piece 1120, and the permanent magnet 1130, detailed descriptions thereof will be omitted.

The second S pole piece 2140 is provided with a first surface 2141 and a second surface 2142, and made of a magnetic material. The second permanent magnet 2150 is disposed such that an N-pole is in contact with the N pole piece 2110, and an S-pole is in contact with the second S pole piece 2120.

Because the first outer pole piece 2200 and the second outer pole piece 2300 are identical to the first outer pole piece 1200 and the second outer pole piece 1300, detailed descriptions thereof will be omitted.

Because the base pole piece 2400 is identical to the base pole piece 1400 except that the base pole piece 2400 has a third surface 2403 and is expanded laterally, a detailed description thereof will be omitted. The first surface 2141 of the second S pole piece 2140 faces the third surface 2403 of the base pole piece 2400.

The third outer pole piece 2600 is provided with a first surface 2601 and a second surface 2602, and made of a magnetic material. The second surface 2142 of the second S pole piece 2140 faces the first surface 2601 of the third outer pole piece 2600.

Figure 2A:
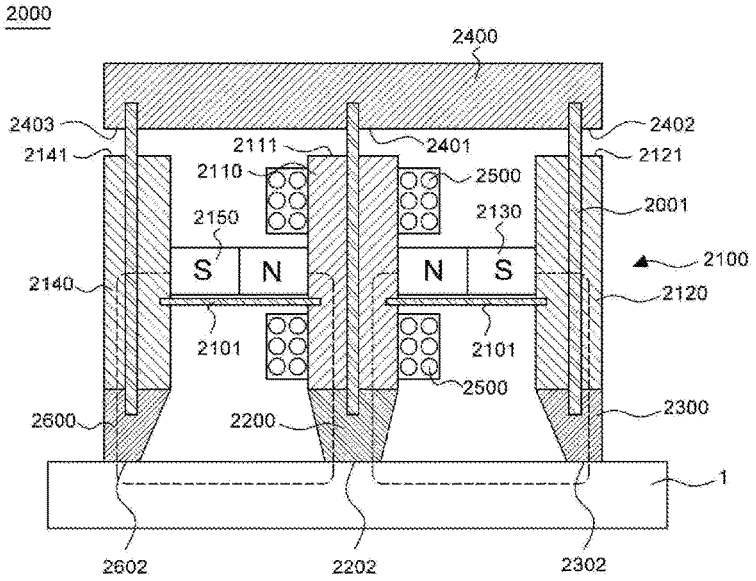
FIGS. 2A to 2D are schematic cross-sectional views of a magnetic flux control device according to another exemplary embodiment of the present disclosure. In addition.
Figure 2B:
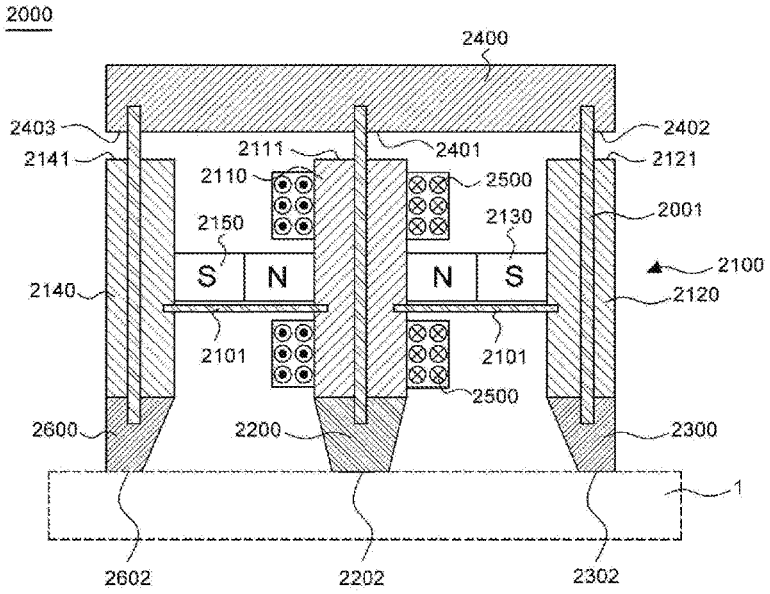
Figure 2C:
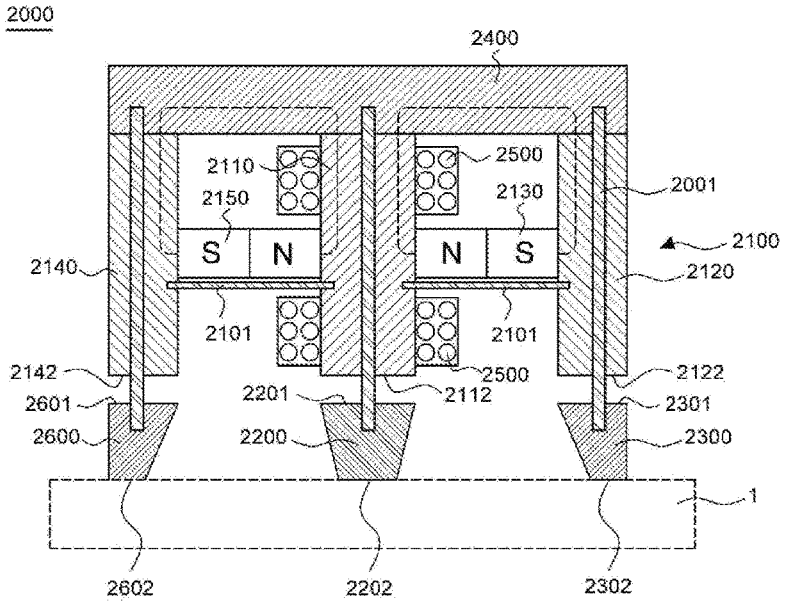
Figure 2D:
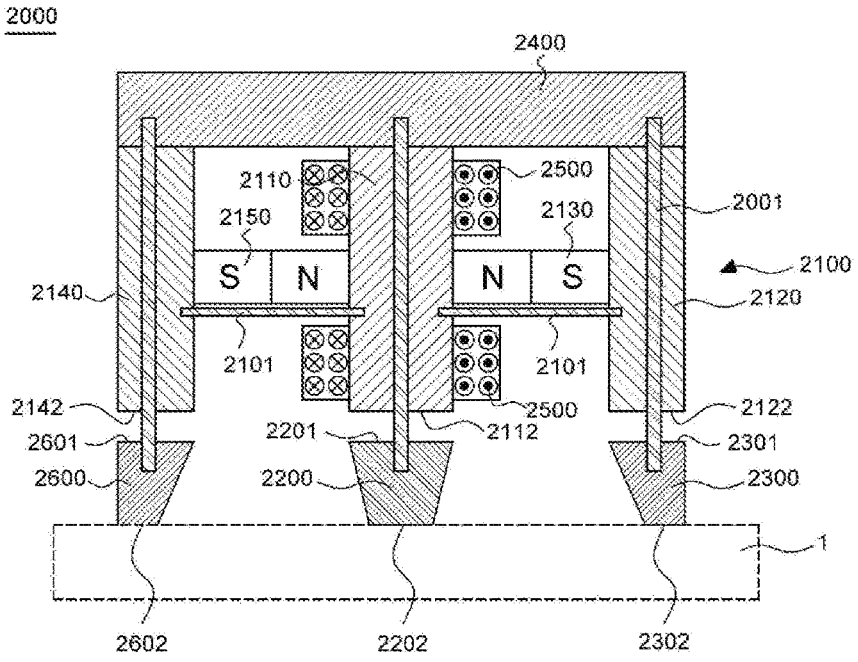
Figure 2E:
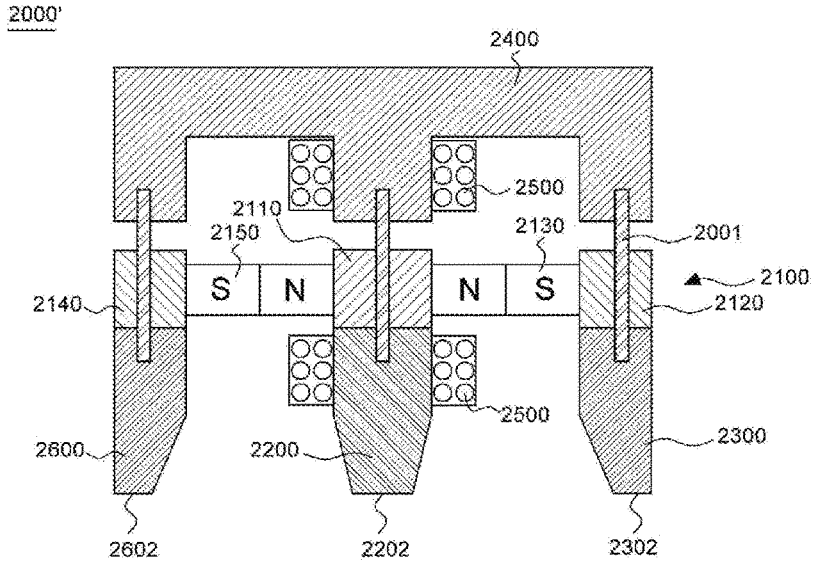
FIGS. 2E and 2F illustrate a modified embodiment in which only coils are disposed differently from those of the magnetic flux control device in FIGS. 2A to 2D.
Figure 2F:
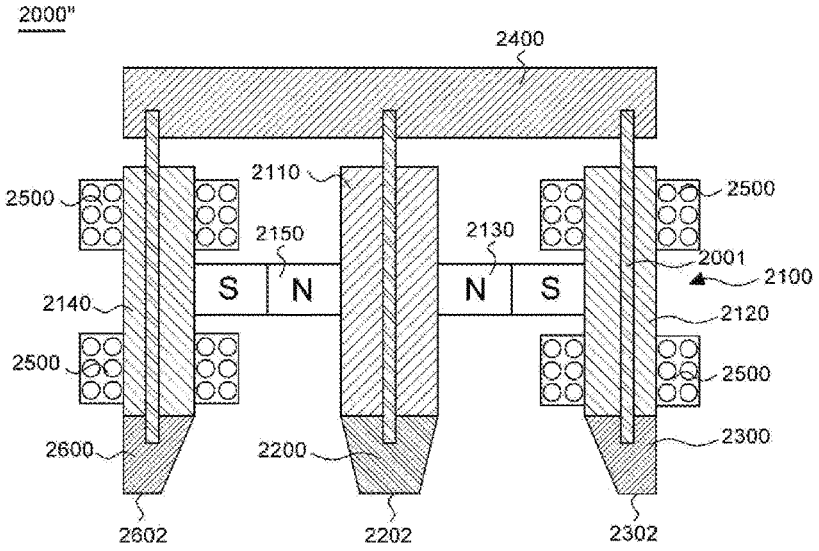

In a case in which the pole piece assembly 2100 is positioned at the first position as illustrated in FIGS. 2A and 2B, the first surface 2141 of the second S pole piece 2140 and the third surface 2403 of the base pole piece 2400 are magnetically spaced apart from each other, and the second surface 2142 of the second S pole piece 2140 and the first surface 2601 of the third outer pole piece 2600 are magnetically in contact with each other. In a case in which the pole piece assembly 2100 is positioned at the second position as illustrated in FIGS. 2C and 2D, the first surface 2141 of the second S pole piece 2140 and the third surface 2403 of the base pole piece 2400 are magnetically in contact with each other, and the second surface 2142 of the second S pole piece 2140 and the first surface 2601 of the third outer pole piece 2600 are magnetically spaced apart from each other.

The coil 2500 is wound around at least one of the N pole piece 2110, the first S pole piece 2120, the second S pole piece 2140, the first outer pole piece 2200, the second outer pole piece 2300, the third outer pole piece 2600, and the base pole piece 2400. In the present exemplary embodiment, the coil 2500 may be wound only around the N pole piece 2110 between the first permanent magnet 2130 and the second permanent magnet 2150, and this is advantageous in terms of reducing a volume of the device 2000.

The magnetic flux control device 2000 according to the present exemplary embodiment further has the second surface 2602, thereby further increasing an area for generating a magnetic field. Likewise, the magnetic flux control device 2000 may be expanded laterally as much as needed.

Meanwhile, fixing means 2101, which fix the pole piece assembly 2100 and are made of a non-magnetic material, may be provided, and unlike the illustrated fixing means 2101, the fixing means 2101 may be configured as a single member that penetrates the N pole piece 2110, the first S pole piece 2120, and the second S pole piece 2140 at once.

Since states illustrated in FIGS. 2A to 2D correspond to the states illustrated in FIGS. 1A to 1D, respectively, a detailed description regarding operations will be omitted.

Meanwhile, the coil 2500 may be disposed in various ways, and like a magnetic flux control device 2000' in FIG. 2E, the coils 2500 may also be disposed on the first outer pole piece 2200 and the base pole piece 2400. In addition, for example, only a single coil 2500 may be disposed between the base pole piece 2400 and the first permanent magnet 2130/the second permanent magnet 2150. In a case in which the coil 2500 is disposed without being wound around the pole piece assembly 2100 as illustrated in FIG. 1E, the pole piece assembly 2100 is light in weight and thus advantageous for movement.

Accordingly, the coils 2500 may include at least one first coil which is positioned on the path of the internally circulating magnetic flux formed when the pole piece assembly 2100 is positioned at the second position as illustrated in FIG. 2C, and at least one second coil which is positioned between the first permanent magnet 2130 and the second surface 2302 of the second outer pole piece 2300, between the second surface 2202 of the first outer pole piece 2200 and the first permanent magnet 2130 and the second permanent magnet 2150, or between the second permanent magnet 2150 and the second surface 2602 of the third outer pole piece 2600. For example, in the exemplary embodiment as illustrated in FIGS. 2A to 2D, the first coil is a coil wound at an upper side of the N pole piece 2110, and in the exemplary embodiment as illustrated in FIG. 2E, the first coil is a coil wound around the base pole piece 2400. In addition, in the exemplary embodiment as illustrated in FIGS. 2A to 2D, the second coil is a coil wound at a lower side of the N pole piece 2110, and in the exemplary embodiment as illustrated in FIG. 2E, the second coil is a coil wound around the first outer pole piece 2200.

In addition, for example, like a magnetic flux control device 2000" in FIG. 2F, two coils 2500 may be disposed on the first S pole piece 2120 in a state in which the first permanent magnet 2130 is disposed between the two coils 2500, and two coils 2500 may be disposed on the second S pole piece 2140 in a state in which the second permanent magnet 2150 is disposed between the two coils 2500.

The coil 2500 may be disposed in more various other ways than described above. The larger the number of coils 2500, the smaller the magnitude of electric current for changing the magnetic field applied state and the no magnetic field applied state and the smaller the number of turns of the coil 2500. However, the larger the number of coils 2500, the more complicated the wiring and the larger the occupied space. Therefore, the number and the disposition of coils 2500 need to be optimized to change the magnetic field applied state and the no magnetic field applied state, easily control magnetic flux, and minimize an occupied internal space. The number and the disposition of coils 2500 may be determined through experiments, taking into account of the number of permanent magnets 2130 and 2150, intensity, thicknesses or lengths of the pole pieces 2110, 2120, 2140, 2200, 2300, 2400, and 2600, and the like.

Figure 3A:
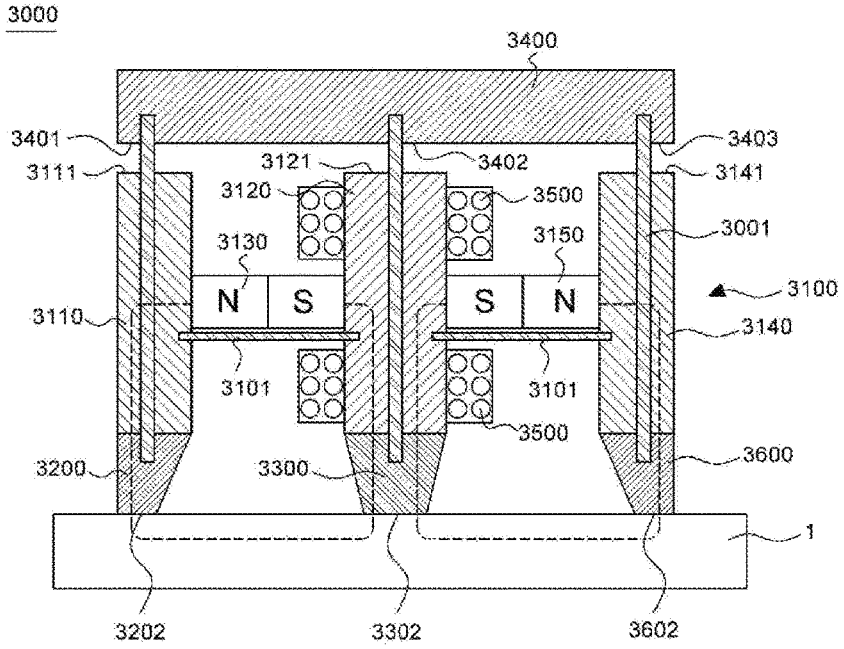
FIGS. 3A and 3B are schematic cross-sectional views of a magnetic flux control device according to yet another exemplary embodiment of the present disclosure.
Figure 3B:
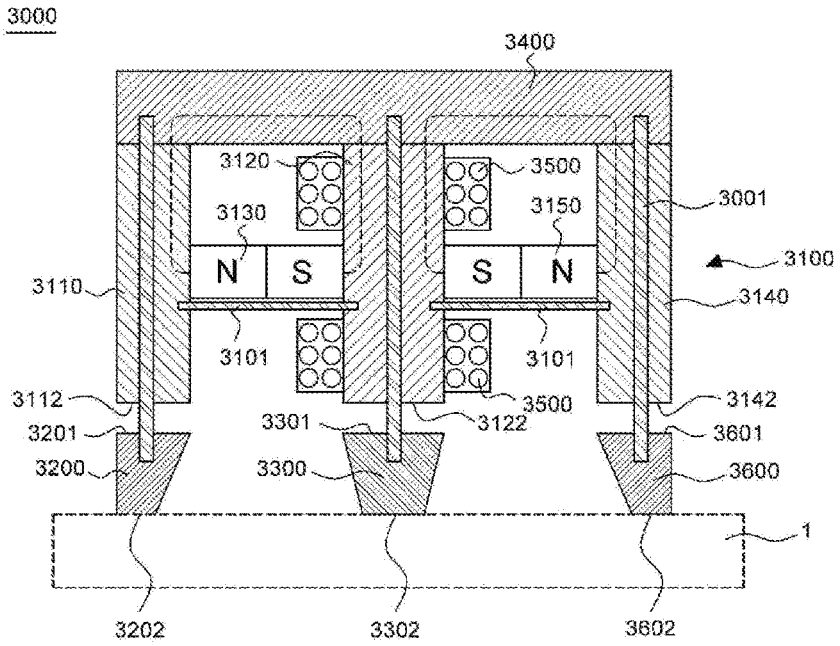

FIGS. 3A and 3B are schematic cross-sectional views of a magnetic flux control device according to yet another exemplary embodiment of the present disclosure.

Referring to FIGS. 3A to 3D, a magnetic flux control device 3000 according to the present exemplary embodiment includes a pole piece assembly 3100, a first outer pole piece 3200, a second outer pole piece 3300, a base pole piece 3400, coils 3500, and a third outer pole piece 3600.

In comparison with the magnetic flux control device 1000 in FIGS. 1A to 1D, the magnetic flux control device 3000 in FIGS. 3A and 3B is expanded laterally by being further provided with a second N pole piece 3140, a second permanent magnet 3150, and a third outer pole piece 3600. In addition, in comparison with the magnetic flux control device 2000 in FIGS. 2A to 2D, there is a difference in that the poles of the permanent magnet are disposed oppositely and an S pole piece 3120 is a position at a center.

The pole piece assembly 3100 includes a first N pole piece 3110, a S pole piece 3120, a first permanent magnet 3130, the second N pole piece 3140, and the second permanent magnet 3150. Here, because the first N pole piece 3110, the S pole piece 3120, and the first permanent magnet 3130 are identical to the N pole piece 1110, the S pole piece 1120, and the permanent magnet 1130, detailed descriptions thereof will be omitted.

The second N pole piece 3140 is provided with a first surface 3141 and a second surface 3142, and made of a magnetic material. The second permanent magnet 3150 is disposed such that an S-pole is in contact with the S pole piece 3120, and an N-pole is in contact with the second N pole piece 3140.

Because the first outer pole piece 3200 and the second outer pole piece 3300 are identical to the first outer pole piece 1200 and the second outer pole piece 1300, detailed descriptions thereof will be omitted.

Because the base pole piece 3400 is identical to the base pole piece 1400 except that the base pole piece 3400 has a third surface 3403 and is expanded laterally, a detailed description thereof will be omitted. The first surface 3141 of the second N pole piece 3140 faces the third surface 3403 of the base pole piece 3400.

The third outer pole piece 3600 is provided with a first surface 3601 and a second surface 3602, and made of a magnetic material. The second surface 3142 of the second N pole piece 3140 faces the first surface 3601 of the third outer pole piece 3600.

In a case in which the pole piece assembly 3100 is positioned at the first position as illustrated in FIG. 3A, the first surface 3141 of the second N pole piece 3140 and the third surface 3403 of the base pole piece 3400 are magnetically spaced apart from each other, and the second surface 3142 of the second N pole piece 3140 and the first surface 3601 of the third outer pole piece 3600 are magnetically in contact with each other. In a case in which the pole piece assembly 3100 is positioned at the second position as illustrated in FIG. 3B, the first surface 3141 of the second N pole piece 3140 and the third surface 3403 of the base pole piece 3400 are magnetically in contact with each other, and the second surface 3142 of the second N pole piece 3140 and the first surface 3601 of the third outer pole piece 3600 are magnetically spaced apart from each other.

The coil 3500 is wound around at least one of the first N pole piece 3110, the S pole piece 3120, the second N pole piece 3140, the first outer pole piece 3200, the second outer pole piece 3300, the third outer pole piece 3600, and the base pole piece 3400. In the present exemplary embodiment, the coil 3500 may be wound only around the S pole piece 3120 between the first permanent magnet 3130 and the second permanent magnet 3150, and this is advantageous in terms of reducing a volume of the device 3000.

The magnetic flux control device 3000 according to the present exemplary embodiment further has the second surface 3602, thereby further increasing an area for generating a magnetic field. Likewise, the magnetic flux control device 3000 may be expanded laterally as much as needed.

Meanwhile, fixing means 3101, which fix the pole piece assembly 3100 and are made of a non-magnetic material, may be provided, and unlike the illustrated fixing means 3101, the fixing means 3101 may be configured as a single member that penetrates the first N pole piece 3110, the S pole piece 3120, and the second N pole piece 3140 at once.

Because states illustrated in FIGS. 3A and 3B correspond to the states illustrated in FIGS. 1A and 1C, respectively, and correspond to the states illustrated in FIGS. 2A and 2C, a detailed description regarding operations will be omitted.

Meanwhile, the coil 3500 may be disposed in various ways. Because the detailed description of the coil 3500 and the description of the magnetic flux control devices 2000, 2000', and 2000" in FIGS. 2A to 2F are duplicated, reference will be made to the description of the magnetic flux control devices 2000, 2000', and 2000', and the detailed description of the coil 3500 will be omitted.

Meanwhile, in the magnetic flux control devices 1000, 1000', 2000, 2000', 2000", and 3000, an area of the first surface 1201, 2201, or 3201 of the first outer pole piece 1200, 2200, or 3200 may be larger than an area of the second surface 1202, 2202, or 3202 of the first outer pole piece 1200, 2200, or 3200 in order to reduce residual magnetism and concentrate magnetic force. In addition, for the same reason, an area of the first surface 1301, 2301, or 3301 of the second outer pole piece 1300, 2300, or 3300 is larger than an area of the second surface 1302, 2302, or 3302 of the second outer pole piece 1300, 2300, or 3300. In addition, for the same reason, an area of the first surface 2601 or 3601 of the third outer pole piece 2600 or 3600 may be larger than an area of the second surface 2602 or 3602 of the third outer pole piece 2600 or 3600. As described in the present specification, a difference in area may be implemented by chamfering or filleting.

Figure 4:
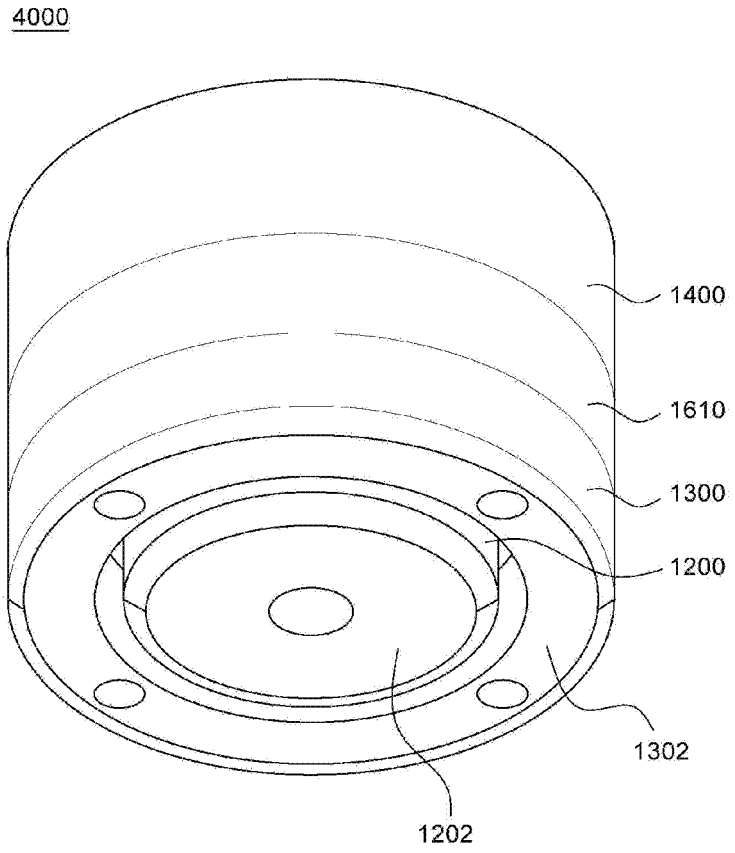
FIG. 4 is a schematic perspective view of the magnetic flux control device according to yet another exemplary embodiment of the present disclosure.

FIG. 4 is a schematic perspective view of the magnetic flux control device according to yet another exemplary embodiment of the present disclosure. In addition, FIG. 5A is a schematic cross-sectional view of the magnetic flux control device in FIG. 4.

A magnetic flux control device 4000 according to the present exemplary embodiment has a similar configuration to the magnetic flux control device 1000 in FIG. 1, and the constituent elements, which perform the same function, are designated by the same reference numerals in the description.

Figure 5A:
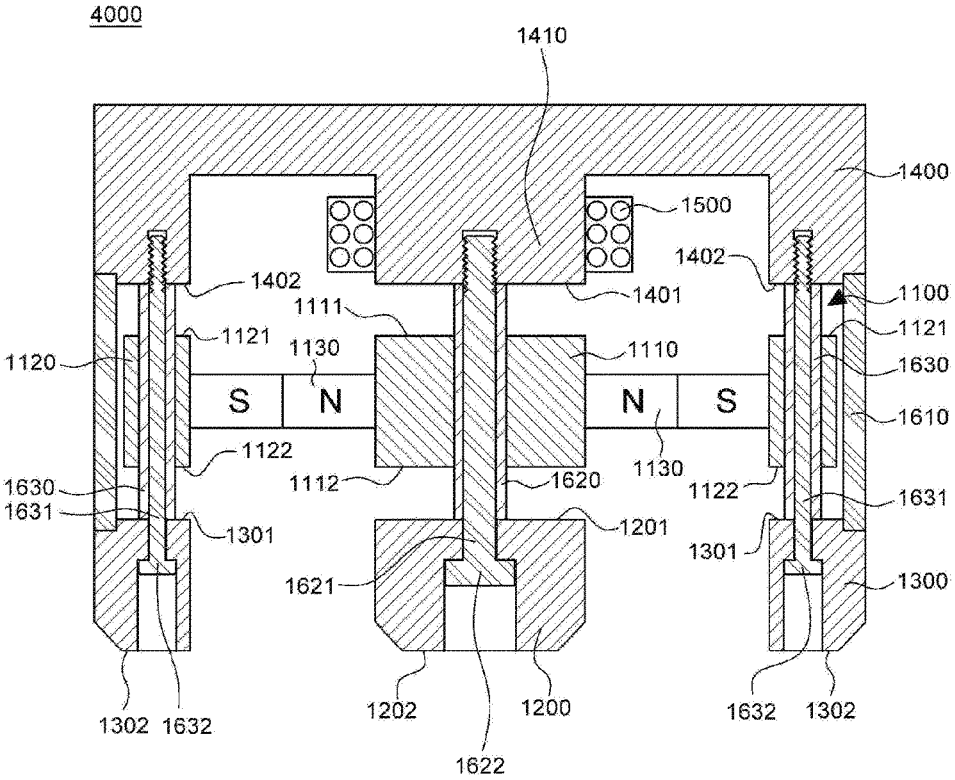
FIG. 5A is a schematic cross-sectional view of the magnetic flux control device in FIG. 4.

Referring to FIGS. 4 and 5A, the magnetic flux control device 4000 according to the present exemplary embodiment includes a pole piece assembly 1100, a first outer pole piece 1200, a second outer pole piece 1300, a base pole piece 1400, a coil 1500, and a control unit (not illustrated).

The pole piece assembly 1100 includes an N pole piece 1110, an S pole piece 1120, and permanent magnets 1130. The N pole piece 1110 has an approximately cylindrical shape, and the S pole piece 1120 has an approximately loop shape so as to surround the N pole piece 1110. Two or more permanent magnets 1130 may be disposed. Because other configurations of the pole piece assembly 1100 are identical to those of the pole piece assembly 1100 in FIGS. 1A to 1D, detailed descriptions thereof will be omitted.

The first outer pole piece 1200 has an approximately cylindrical shape, and the second outer pole piece 1300 has an approximately loop shape so as to surround the first outer pole piece 1200.

The base pole piece 1400 includes a protruding portion 1410 that includes a first surface 1401. The coil 1500 is wound around the protruding portion 1410. Therefore, the coil 1500 is not exposed to the outside.

The pole piece assembly 1100, the first outer pole piece 1200, the second outer pole piece 1300, and the base pole piece 1400 may be coupled by means of an outer support body 1610, a first inner support body 1620, and second inner support bodies 1630.

The outer support body 1610 is disposed between the base pole piece 1400 and the second outer pole piece 1300 so as to surround the pole piece assembly 1100. The outer support body 1610 is strongly coupled to the base pole piece 1400 and the second outer pole piece 1300, such that the base pole piece 1400 and the second outer pole piece 1300 are coupled to each other.

The first inner support body 1620 is disposed between the base pole piece 1400 and the first outer pole piece 1200. The first inner support body 1620 penetrates the N pole piece 1110 and guides the movement of the pole piece assembly 1100. The first inner support body 1620 has a hollow cylindrical shape, and a coupling bolt 1621 is inserted into the hollow space. An end portion of the coupling bolt 1621 is thread-coupled to the base pole piece 1400, and a head 1622 is caught by the first outer pole piece 1200, thereby coupling the base pole piece 1400 and the first outer pole piece 1200.

The second inner support body 1630 is disposed between the base pole piece 1400 and the second outer pole piece 1300. The second inner support body 1630 penetrates the S pole piece 1120 and guides the movement of the pole piece assembly 1100. The second inner support body 1630 has a hollow cylindrical shape, and coupling bolts 1631 are inserted into the hollow space. An end portion of the coupling bolt 1631 is thread-coupled to the base pole piece 1400, and a head 1632 is caught by the second outer pole piece 1300, thereby coupling the base pole piece 1400 and the second outer pole piece 1300.

The first inner support body 1620 and the second inner support body 1630 serve to maintain constant distances between the base pole piece 1400 and the outer pole pieces 1200 and 1300, and also serve to guide the movement of the pole piece assembly 1100. Therefore, in order to reduce friction that occurs when the pole piece assembly 1100 moves, smaller surface roughness of outer circumferential surfaces of the first inner support body 1620 and the second inner support body 1630 is advantageous.

The outer support body 1610, the first inner support body 1620, and the second inner support body 1630 may be made of a paramagnetic material or a non-magnetic material so as not to affect magnetic flux. For example, the support bodies 1610, 1620, and 1630 may be made of aluminum, aluminum alloy, polymeric resin, or the like.

Meanwhile, like the support bodies 1610, 1620, and 1630, the coupling bolts 1621 and 1631 may also be made of a paramagnetic material or a non-magnetic material.

Force may be transmitted between the base pole piece 1400 and the outer pole pieces 1200 and 1300 through the coupling bolts 1621 and 1631, and thus the diameters, the lengths, and the number of coupling bolts 1621 and 1631 may be determined, appropriately taking into account of a load to be withstood. The present exemplary embodiment, four second inner support bodies 1630 and four coupling bolts 1631 are applied as an example, but a larger number of support bodies or a larger number of coupling bolts may be applied.

Meanwhile, the configurations of the support bodies 1610, 1620, and 1630 and the coupling bolts 1621 and 1631 may of course be applied to the magnetic flux control devices 1000, 2000, and 3000.

The coil 1500 may be wound around any pole pieces at which magnetic flux is formed, but as described in the present exemplary embodiment, the coil 1500 may be wound around the protruding portion 1410 of the base pole piece 1400 so as to minimize control electric power. However, even in a case in which control electric power is somewhat increased, the coil 1500 may be wound around the first outer pole piece 1200. In addition, the coil 1500 may be wound around the protruding portion 1410 and the first outer pole piece 1200, respectively. The disposition of the coil 1500 may be selected appropriately in accordance with design specifications.

Because an operating method is the same as described with reference to FIGS. 1A to 1D, a detailed description thereof will be omitted.

Meanwhile, in the present exemplary embodiment, the N pole piece 1110 and the first outer pole piece 1200 are illustrated as being disposed to be surrounded by the S pole piece 1120 and the second outer pole piece 1300, respectively, but on the contrary, the S pole piece 1120 and the second outer pole piece 1300 may be disposed to be surrounded by the N pole piece 1110 and the first outer pole piece 1200, respectively.

Figure 5B:
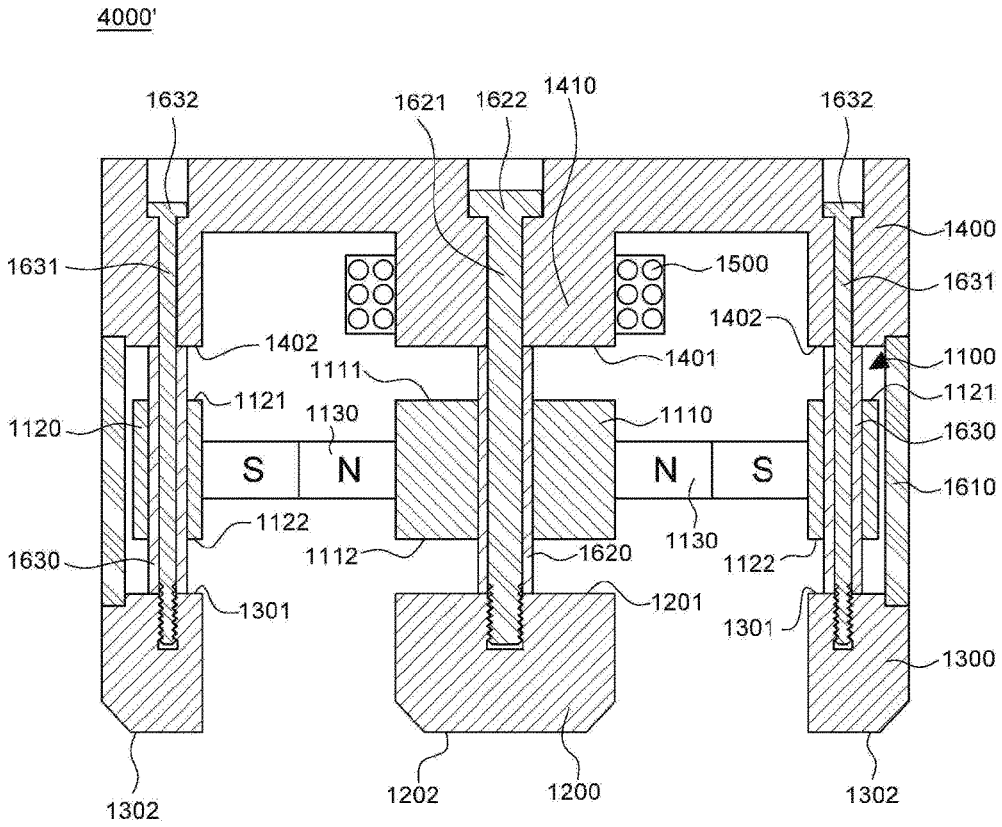
FIG. 5B is a schematic cross-sectional view of a modified embodiment of the magnetic flux control device in FIG. 5A.

FIG. 5B is a schematic cross-sectional view of a modified embodiment of the magnetic flux control device in FIG. 5A.

In FIG. 5A, the heads 1622 and 1632 of the coupling bolts 1621 and 1631 are positioned in the outer pole pieces 1200 and 1300. On the contrary, as illustrated in FIG. 5B, the coupling bolts 1621 and 1631 may be inserted and coupled from the base pole piece 1400 so that the heads 1622 and 1632 may be disposed at the base pole piece 1400.

Specifically, a magnetic flux control device 4000' according to the present exemplary embodiment further include a coupling bolt 1621 which penetrates the first inner support body 1620 such that an end portion of the coupling bolt 1621 is thread-coupled to the first outer pole piece 1200, and a head 1622 is caught by the base pole piece 1400 so as to couple the base pole piece 1400 and the first outer pole piece 1200.

In addition, the magnetic flux control device 4000' according to the present exemplary embodiment may further include a coupling bolt 1631 which penetrates the second inner support body 1630 such that an end portion of the coupling bolt 1631 is thread-coupled to the second outer pole piece 1300, and a head 1632 is caught by the base pole piece 1400 so as to couple the base pole piece 1400 and the second outer pole piece 1300.

The configuration and the coupling method are advantageous in increasing areas of the second surfaces 1202 and 1302 of the outer pole pieces 1200 and 1300.

Figure 6:
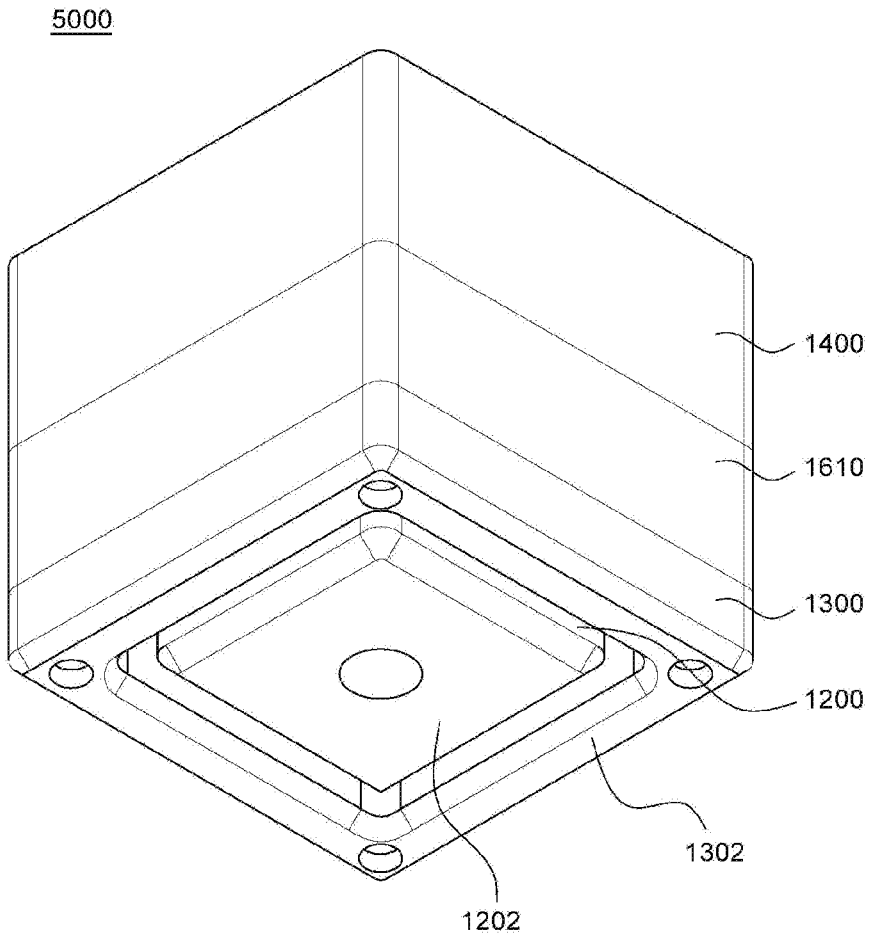
FIG. 6 is a schematic perspective view of the magnetic flux control device according to still yet another exemplary embodiment of the present disclosure.

FIG. 6 is a schematic perspective view of the magnetic flux control device according to still yet another exemplary embodiment of the present disclosure.

A magnetic flux control device 5000 according to the present exemplary embodiment is identical to the magnetic flux control device 4000 in FIGS. 4 and 5 except that the magnetic flux control device 5000 has a first outer pole piece 1200 having an approximately quadrangular shape.

Meanwhile, in the magnetic flux control devices 4000 and 5000, an area of the first surface 1201 of the first outer pole piece 1200 may be larger than an area of the second surface 1202 of the first outer pole piece 1200 in order to reduce residual magnetism and concentrate magnetic force. In addition, for the same reason, an area of the first surface 1301 of the second outer pole piece 1300 may be larger than an area of the second surface 1302 of the second outer pole piece 1300. As described in the present specification, a difference in area may be implemented by chamfering or filleting.

The magnetic flux control devices 1000, 1000', 2000, 3000, 4000, and 5000 may generate a magnetic field outside the devices and eliminate the magnetic field, and thus may be used as a magnetic material holding device. In addition, the device generates a fluctuation in magnetic field so as to move a magnetic material positioned outside the device. Therefore, the device may be applied to an electric generator, a power engine, or the like.

Meanwhile, the magnetic flux control device 1000, 1000', 2000, 3000, 4000, or 5000 according to the present disclosure controls electric current to be applied to the coil 1500 even though no magnetic material is present on the second surfaces 1202 and 1302 of the outer pole pieces 1200 and 1300, such that the pole piece assembly 1100 may be moved between the first position and the second position, and therefore, the magnetic field applied state and the no magnetic field applied state may be changed.

The magnetic flux control device 1000, 1000', 2000, 3000, 4000, or 5000 may be controlled even by a small magnitude of direct current, and the direct current is used only when the magnetic field applied state and the no magnetic field applied state are changed, such that electric power consumption is low. Therefore, the device may be used as a means for providing environmentally-friendly energy.

Furthermore, like the magnetic flux control devices 4000 and 5000, any one of the N pole piece 1110 and the S pole piece 1120 is disposed to surround the other of the N pole piece 1110 and the S pole piece 1120, such that in a case in which a structure in which any one of the first outer pole piece 1200 and the second outer pole piece 1300 is disposed to surround the other of the first outer pole piece 1200 and the second outer pole piece 1300 is selected, a production process is simplified, and production costs may be reduced. In addition, a portion, where the second surface 1202 of the first outer pole piece 1200 and the second surface 1302 of the second outer pole piece 1300 are adjacent to each other, may be maximized, thereby maximizing holding force.

While the exemplary embodiments of the present disclosure have been described with reference to the accompanying drawings, those skilled in the art will understand that the present disclosure may be implemented in any other specific form without changing the technical spirit or an essential feature thereof. Thus, it should be appreciated that the exemplary embodiments described above are intended to be illustrative in every sense, and not restrictive.

What is claimed is:

1. A magnetic flux control device comprising:

a pole piece assembly which is provided with an N pole piece which is formed with a first surface and a second surface and made of a ferromagnetic material, an S pole piece which is formed with a first surface and a second surface and made of a ferromagnetic material, and a permanent magnet which is disposed such that an N-pole is in contact with the N pole piece and an S-pole is in contact with the S pole piece;

a first outer pole piece which is formed with a first surface and a second surface and made of a magnetic material;

a second outer pole piece which is formed with a first surface and a second surface and made of a magnetic material;

a base pole piece which is formed with a first surface and a second surface and made of a magnetic material;

a coil which is wound around at least one of the N pole piece, the S pole piece, the first outer pole piece, the second outer pole piece, and the base pole piece; and a control unit which controls electric current to be applied to the coil, wherein the first surface of the N pole piece faces the first surface of the base pole piece, the first surface of the S pole piece faces the second surface of the base pole piece, the second surface of the N pole piece faces the first surface of the first outer pole piece, the second surface of the S pole piece faces the first surface of the second outer pole piece, the pole piece assembly is movable between a first position where the first surface and the second surface of the base pole piece are magnetically spaced apart from the first surface of the N pole piece and the first surface of the S pole piece, respectively, and the second surface of the N pole piece and the second surface of the S pole piece are magnetically in contact with the first surface of the first outer pole piece and the first surface of the second outer pole piece, respectively, and a second position where the first surface and the second surface of the base pole piece are magnetically in contact with the first surface of the N pole piece and the first surface of the S pole piece, respectively, and the second surface of the N pole piece and the second surface of the S pole piece are magnetically spaced apart from the first surface of the first outer pole piece and the first surface of the second outer pole piece, respectively, and the control unit controls electric current to be applied to the coil so as to move the pole piece assembly between the first position and the second position, and thus to change magnetic flux at the second surface of the first outer pole piece and the second surface of the second outer pole piece.

2. The magnetic flux control device of claim 1, wherein the S pole piece is a first S pole piece, the permanent magnet is a first permanent magnet, the magnetic flux control device further includes a third outer pole piece which is formed with a first surface and a second surface and made of a ferromagnetic material, the pole piece assembly further includes a second S pole piece which is formed with a first surface and a second surface and made of a ferromagnetic material, and a second permanent magnet which is disposed such that an N-pole is in contact with the N pole piece and an S-pole is in contact with the second S pole piece, the base pole piece further includes a third surface, the first surface of the second S pole piece faces the third surface of the base pole piece, the second surface of the second S pole piece faces the first surface of the third outer pole piece, the first surface of the second S pole piece and the third surface of the base pole piece are magnetically spaced apart from each other and the second surface of the second S pole piece and the first surface of the third outer pole piece are magnetically in contact with each other when the pole piece assembly is positioned at the first position, the first surface of the second S pole piece and the third surface of the base pole piece are magnetically in contact with each other and the second surface of the second S pole piece and the first surface of the third outer pole piece are magnetically spaced apart from each other when the pole piece assembly is positioned at the second position, and the coil is wound around at least one of the N pole piece, the first S pole piece, the second S pole piece, the first outer pole piece, the second outer pole piece, the third outer pole piece, and the base pole piece.

3. The magnetic flux control device of claim 2, wherein the coils include at least one first coil which is positioned on the path of internally circulating magnetic flux formed when the pole piece assembly is positioned at the second position, and at least one second coil which is positioned between the first permanent magnet and the second surface of the second outer pole piece, between the first permanent magnet and the second permanent magnet and the second surface of the first outer pole piece, or between the second permanent magnet and the second surface of the third outer pole piece.

4. The magnetic flux control device of claim 2, wherein the coil is wound around the N pole piece, and the coils include a first coil which is positioned between the first permanent magnet and the second permanent magnet and the base pole piece, and a second coil which is positioned between the first permanent magnet and the second permanent magnet and the first outer pole piece.

5. The magnetic flux control device of claim 2, wherein an area of the first surface of the third outer pole piece is larger than an area of the second surface of the third outer pole piece.

6. The magnetic flux control device of claim 1, wherein the N pole piece is a first N pole piece, the permanent magnet is a first permanent magnet, the magnetic flux control device further includes a third outer pole piece which is formed with a first surface and a second surface and made of a ferromagnetic material, the pole piece assembly further includes a second N pole piece which is formed with a first surface and a second surface and made of a ferromagnetic material, and a second permanent magnet which is disposed such that an S-pole is in contact with the S pole piece and an N-pole is in contact with the second N pole piece, the base pole piece further includes a third surface, the first surface of the second N pole piece faces the third surface of the base pole piece, the second surface of the second N pole piece faces the first surface of the third outer pole piece, the first surface of the second N pole piece and the third surface of the base pole piece are magnetically spaced apart from each other and the second surface of the second N pole piece and the first surface of the third outer pole piece are magnetically in contact with each other when the pole piece assembly is positioned at the first position, the first surface of the second N pole piece and the third surface of the base pole piece are magnetically in contact with each other and the second surface of the second N pole piece and the first surface of the third outer pole piece are magnetically spaced apart from each other when the pole piece assembly is positioned at the second position, and the coil is wound around at least one of the first N pole piece, the second N pole piece, the S pole piece, the first outer pole piece, the second outer pole piece, the third outer pole piece, and the base pole piece.

7. The magnetic flux control device of claim 6, wherein the coils include at least one first coil which is positioned on the path of internally circulating magnetic flux formed when the pole piece assembly is positioned at the second position, and at least one second coil which is positioned between the first permanent magnet and the second surface of the second outer pole piece, between the first permanent magnet and the second permanent magnet and the second surface of the first outer pole piece, or between the second permanent magnet and the second surface of the third outer pole piece.

8. The magnetic flux control device of claim 6, wherein the coil is wound around the S pole piece, and the coils include a first coil which is positioned between the first permanent magnet and the second permanent magnet and the base pole piece, and a second coil which is positioned between the first permanent magnet and the second permanent magnet and the second outer pole piece.

9. The magnetic flux control device of claim 6, wherein an area of the first surface of the third outer pole piece is larger than an area of the second surface of the third outer pole piece.

10. The magnetic flux control device of claim 1, wherein the coils include at least one first coil which is positioned on the path of internally circulating magnetic flux formed when the pole piece assembly is positioned at the second position, and at least one second coil which is positioned between the permanent magnet and the second surface of the first outer pole piece or between the permanent magnet and the second surface of the second outer pole piece.

11. The magnetic flux control device of claim 1, wherein an area of the first surface of the first outer pole piece is larger than an area of the second surface of the first outer pole piece.

12. The magnetic flux control device of claim 1, wherein an area of the first surface of the second outer pole piece is larger than an area of the second surface of the second outer pole piece.

13. The magnetic flux control device of claim 1, wherein the pole piece assembly further includes a fixing means which inhibits relative movements between the pole pieces included in the pole piece assembly.

14. The magnetic flux control device of claim 1, wherein coil is not wound around the pole pieces included in the pole piece assembly.

15. The magnetic flux control device of claim 1, wherein any one of the N pole piece and the S pole piece is disposed to surround the other of the N pole piece and the S pole piece.

16. The magnetic flux control device of claim 15, wherein the S pole piece is disposed to surround the N pole piece, the second outer pole piece is disposed to surround the first outer pole piece, and an outer support body, which is disposed to surround the pole piece assembly, is further provided between the base pole piece and the second outer pole piece.

17. The magnetic flux control device of claim 16, wherein the outer support body is made of a paramagnetic material or a non-magnetic material.

18. The magnetic flux control device of claim 16, wherein the base pole piece is provided with a protruding portion that includes the first surface of the base pole piece, and the coil is disposed to be wound around the protruding portion.

19. The magnetic flux control device of claim 16, wherein the coil is disposed to be wound around the first outer pole piece.

20. The magnetic flux control device of claim 15, further comprising: an inner support body which is disposed between the base pole piece and the first outer pole piece, penetrates the N pole piece, and guides the movement of the pole piece assembly.

21. The magnetic flux control device of claim 20, further comprising: a coupling bolt which penetrates the inner support body such that an end portion of the coupling bolt is thread-coupled to the base pole piece and a head of the coupling bolt is caught by the first outer pole piece so as to couple the base pole piece and the first outer pole piece.

22. The magnetic flux control device of claim 20, a coupling bolt which penetrates the inner support body such that an end portion of the coupling bolt is thread-coupled to the first outer pole piece and a head of the coupling bolt is caught by the base pole piece so as to couple the base pole piece and the first outer pole piece.

23. The magnetic flux control device of claim 20, wherein the inner support body is made of a paramagnetic material or a non-magnetic material.

24. The magnetic flux control device of claim 15, wherein an area of the first surface of the first outer pole piece is larger than an area of the second surface of the first outer pole piece.

25. The magnetic flux control device of claim 15, wherein an area of the first surface of the second outer pole piece is larger than an area of the second surface of the second outer pole piece.

26. The magnetic flux control device of claim 15, wherein any one of the second surface of the first outer pole piece and the second surface of the second outer pole piece has a circular shape.

27. The magnetic flux control device of claim 15, wherein any one of the second surface of the first outer pole piece and the second surface of the second outer pole piece has a quadrangular shape.

28. The magnetic flux control device of claim 1, wherein the N pole piece is disposed to surround the S pole piece, the first outer pole piece is disposed to surround the second outer pole piece, and an outer support body, which is disposed to surround the pole piece assembly, is further provided between the base pole piece and the first outer pole piece.

29. The magnetic flux control device of claim 28, wherein the outer support body is made of a paramagnetic material or a non-magnetic material.

30. The magnetic flux control device of claim 28, wherein the base pole piece is provided with a protruding portion that includes the second surface of the base pole piece, and the coil is disposed to be wound around the protruding portion.

31. The magnetic flux control device of claim 28, wherein the coil is disposed to be wound around the second outer pole piece.

32. The magnetic flux control device of claim 1, further comprising: an inner support body which is disposed between the base pole piece and the second outer pole piece, penetrates the S pole piece, and guides the movement of the pole piece assembly.

33. The magnetic flux control device of claim 32, further comprising: a coupling bolt which penetrates the inner support body such that an end portion of the coupling bolt is thread-coupled to the base pole piece and a head of the coupling bolt is caught by the second outer pole piece so as to couple the base pole piece and the second outer pole piece.

34. The magnetic flux control device of claim 32, a coupling bolt which penetrates the inner support body such that an end portion of the coupling bolt is thread-coupled to the second outer pole piece and a head of the coupling bolt is caught by the base pole piece so as to couple the base pole piece and the second outer pole piece.

35. The magnetic flux control device of claim 32, wherein the inner support body is made of a paramagnetic material or a non-magnetic material.

* * * * *